US005970274A

United States Patent [19]

Rath

[11] Patent Number: 5,970,274

[45] Date of Patent: Oct. 19, 1999

[54] JAM DETECTION SYSTEM

[75] Inventor: Todd R. Rath, Webster, N.Y.

[73] Assignee: Xerox Corporation, Stamford, Conn.

[21] Appl. No.: 09/186,940

[22] Filed: Nov. 6, 1998

[51] Int. Cl.[6] ..... G03G 15/00

[52] U.S. Cl. ..... 399/21; 271/258.03; 399/19

[58] Field of Search ..... 399/21, 16, 18, 399/19; 271/258.03, 258.01, 265.01

[56] References Cited

U.S. PATENT DOCUMENTS

| | | | |
|---|---|---|---|
| 4,054,380 | 10/1977 | Donohue et al. . | |
| 4,084,900 | 4/1978 | Yamaoka et al. . | |
| 4,153,241 | 5/1979 | Batchelor et al. | 271/265 X |
| 4,163,897 | 8/1979 | Hubbard et al. | 235/92 |
| 4,176,941 | 12/1979 | Breitenkam et al. | 399/24 |
| 4,213,190 | 7/1980 | Finlay et al. | 364/900 |
| 4,229,100 | 10/1980 | Travis | 271/291 X |
| 4,307,957 | 12/1981 | Kitagawa et al. | 399/21 |
| 4,377,333 | 3/1983 | Tsuji et al. | 399/18 |
| 4,908,655 | 3/1990 | Takagi | 355/50 |
| 4,996,557 | 2/1991 | Takagi | 355/50 |
| 5,018,718 | 5/1991 | Matsuno et al. | 271/245 |
| 5,034,780 | 7/1991 | Kotabe et al. | 399/21 |

*Primary Examiner*—Matthew S. Smith
*Attorney, Agent, or Firm*—H. Fleischer; J. E. Beck

[57] ABSTRACT

An apparatus for predicting a location of a sheet being transported along a path of movement after the occurrence of a sheet jam. A sheet jam detecting device is disposed along the path of movement of the sheet. The sheet jam detecting device detects the sheet jam along the path of movement and generates a sheet jam signal. A sensor is operatively associated with the transport to detect the continued movement of the transport after the jam detecting device detects the sheet jam. The sensor generates a transport signal. A processor is in communication with the jam detecting device and the sensor for receiving the sheet jam signal and the transport signal. The detector predicts the location of the sheet as a function of these signals. An apparatus of this type may be used in a printing machine for detecting the location of sheets after the occurrence of a sheet jam.

21 Claims, 2 Drawing Sheets

JAM DETECTION SYSTEM

Figure 1:
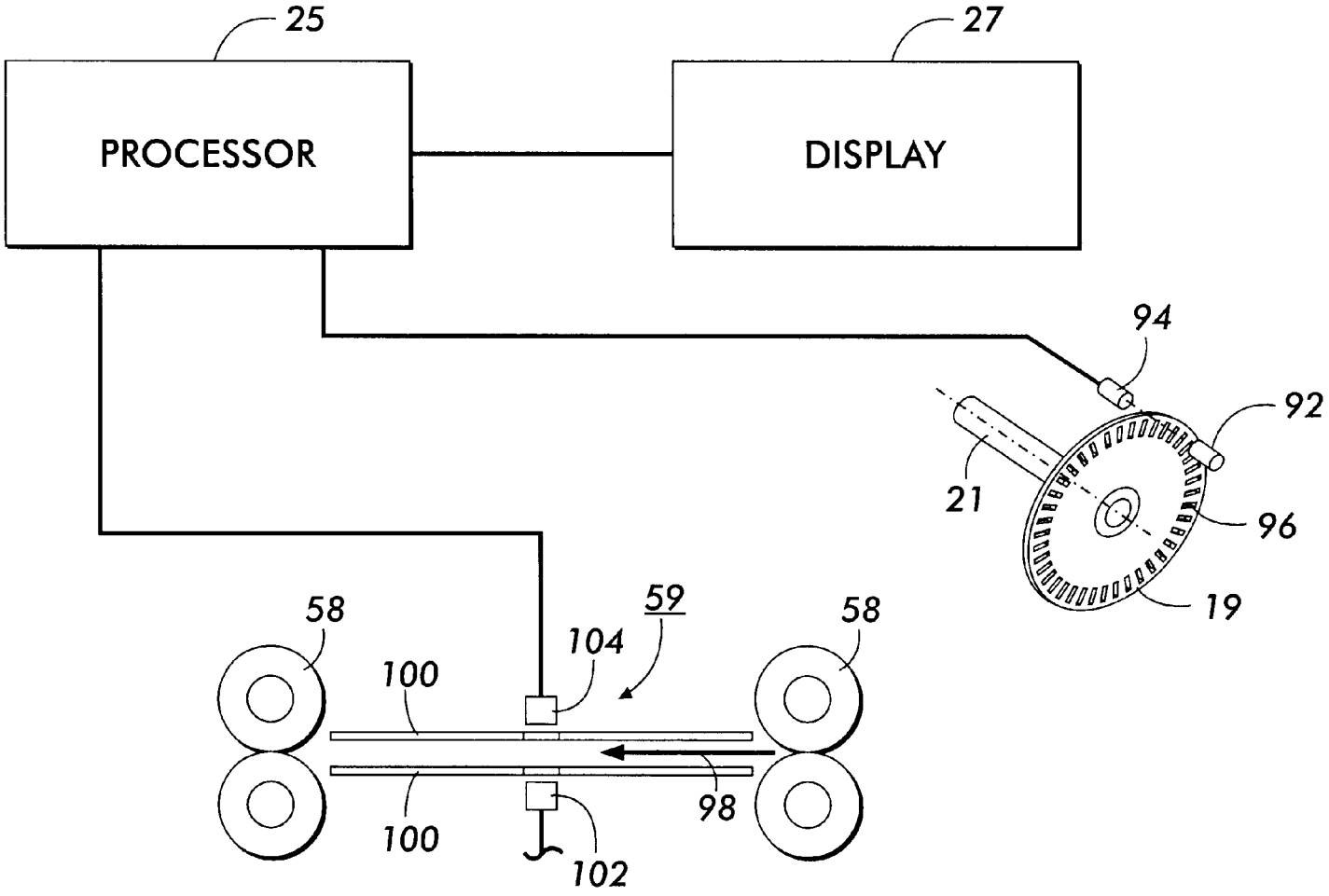

The present invention relates to a printing machine, and more particularly, concerns detecting jammed sheets along a path of movement in the printing machine Generally, an electrophotographic printing machine includes a photoconductive member which is charged to a substantially uniform potential to sensitize the surface thereof. The charged portion of the photoconductive surface is exposed to a light image of an original document being reproduced. This records an electrostatic latent image on the photoconductive member corresponding to the informational areas contained within the original document. After the electrostatic latent image is recorded on the photoconductive member, a developer mix is brought into contact therewith. This forms a powder image on the photoconductive member which is subsequently transferred to a copy sheet. Finally, the copy sheet is heated to permanently affix the powder image thereto in image configuration. One skilled in the art will appreciate that in lieu of a dry developer material, a liquid developer material may be used.

In today's high speed electrophotographic printing machines, copy sheets are handled and advanced throughout the various processing stations of the printing machine. Not only must each copy sheet be handled without marring or destroying the sheet, but also, misfeeds and multiple feeds must be detected and prevented. The foregoing not only applies to copy sheets, but also to original documents being handled by document handling systems.

As the copy sheet is being conveyed through the various processing stations in the printing machine, there is a possibility that the sheet may become jammed in the printing machine. Various types of devices has been developed for detecting sheet jams. For example, the leading and trailing edges of the sheet may be detected, and, in the event the trailing edge is not detected, a sheet jam declared. It is not only important to detect the occurrence of a sheet jam, but it is also important to determine the location of the sheet jam. In high speed printing machines, many sheets may be moving along the sheet path in addition to the jammed sheet. Only in this way will the machine operator be capable of easily removing all of the sheets and returning the printing machine to operational status. The printing machine has a tendency to coast after a sheet jam has occurred. This results in many of the sheets stopping further downstream than where the sensors indicated. Thus, it is highly desirable to be capable of predicting where the sheets will actually stop after the jam is detected.

The following disclosures may be relevant to various aspects of the present invention:

- U.S. Pat. No. 4,054,380 Patentee: Donohue, et al. Issued: Oct. 18, 1977
- U.S. Pat. No. 4,084,900 Patentee: Yamaoka, et al. Issued: Apr. 18, 1978
- U.S. Pat. No. 4,163,897 Patentee: Hubbard, et al. Issued: Aug. 7, 1979
- U.S. Pat. No. 4,213,190 Patentee: Finlay, et al. Issued: Jul. 15, 1980

The relevant portions of the foregoing disclosures may be briefly summarized as follows:

U.S. Pat. No. 4,054,380 discloses a jam detection system which interrogates switches in the paper path. If the paper is not on a paper path switch at the right time or is on a paper path switch at the wrong time when the logic cycles are sampled, the appropriate type of jam will be declared and the machine will be stopped.

U.S. Pat. No. 4,084,900 describes a jam detecting circuit for detecting a copy paper jam in the printing machine. A circuit measures a time interval between a starting circuit and a second paper detecting circuit. If the time interval measured exceeds a predetermined period of time defined in an alarm circuit, an alarm either visual or auditory, is actuated providing an indication to the machine operator that a paper jam has occurred at some place in the copying machine. In addition, the alarm circuit may cause the copying machine to stop subsequent copying operations.

U.S. Pat. No. 4,163,897 discloses a jam detection circuit which transmits a jam detected signal. The detection of the jam stops the production of the copies in the printing machine. The operator then opens the door to the printing machine and removes partially completed copies residing therein. Such removal may require the operator to move portions of the copy path transport. Upon completion of the physical recovery of the sheets, the operator actuates a misfeed reset switch signifying to the printing machine that the operator has completed the physical portion of the jam recovery. A switch then sends a signal over a line to reinitiate operation of the printing machine in the recovery mode.

U.S. Pat. No. 4,213,190 describes detecting a sheet jam and clearing the copy sheets form the paper path while the photoconductor drum is coasting or has just coasted to a stop.

In accordance with one aspect of the present invention, there is provided a printing machine of the type having a moving photoconductive member and processing stations disposed about the path of movement thereof. A jam detecting device is disposed along the path of movement of the sheet. The jam detecting device detects a sheet jam along the path of movement and generates a sheet jam signal. A sensor is operatively associated with the photoconductive member to detect the continued movement of the photoconductive member after the jam detecting device detects the sheet jam. The sensor generates a photoconductor signal. A processor, in communication with the jam detecting device and the sensor, receives the sheet jam signal and the photoconductor signal, and, in response thereto, predicts the location of sheets along the path of movement.

Pursuant to another aspect of the present invention, there is provided an apparatus for predicting the location of sheets being advanced along a path of movement by a transport after an occurrence of a sheet jam. The apparatus includes a jam detecting device, disposed along the path of movement of the sheets, for detecting a sheet jam along the path of movement thereof, and generating a sheet jam signal. A sensor is operatively associated with the transport and detects the continued movement of the transport after the jam detecting device detects the sheet jam and generates a transport signal. A processor, in communication with the jam detecting device and the sensor, receives the sheet jam signal and the transport signal. The processor predicts the location of the sheets along the path of movement.

Pursuant to still another aspect of the present invention, there is provided another method of predicting the location of sheets moving along a path in a printing machine after the occurrence of a sheet jam. The printing machine has processing stations disposed about a photoconductive member to form indicia on the sheet. The method includes detecting a sheet jam along the path of movement thereof and generating a sheet jam signal. The continued movement of the photoconductive member after the detecting step is sensed and a photoconductor signal generated. The sheet jam signal and the photoconductor signal are processed to predict the location of the sheets along the path of movement.

Figure 2:
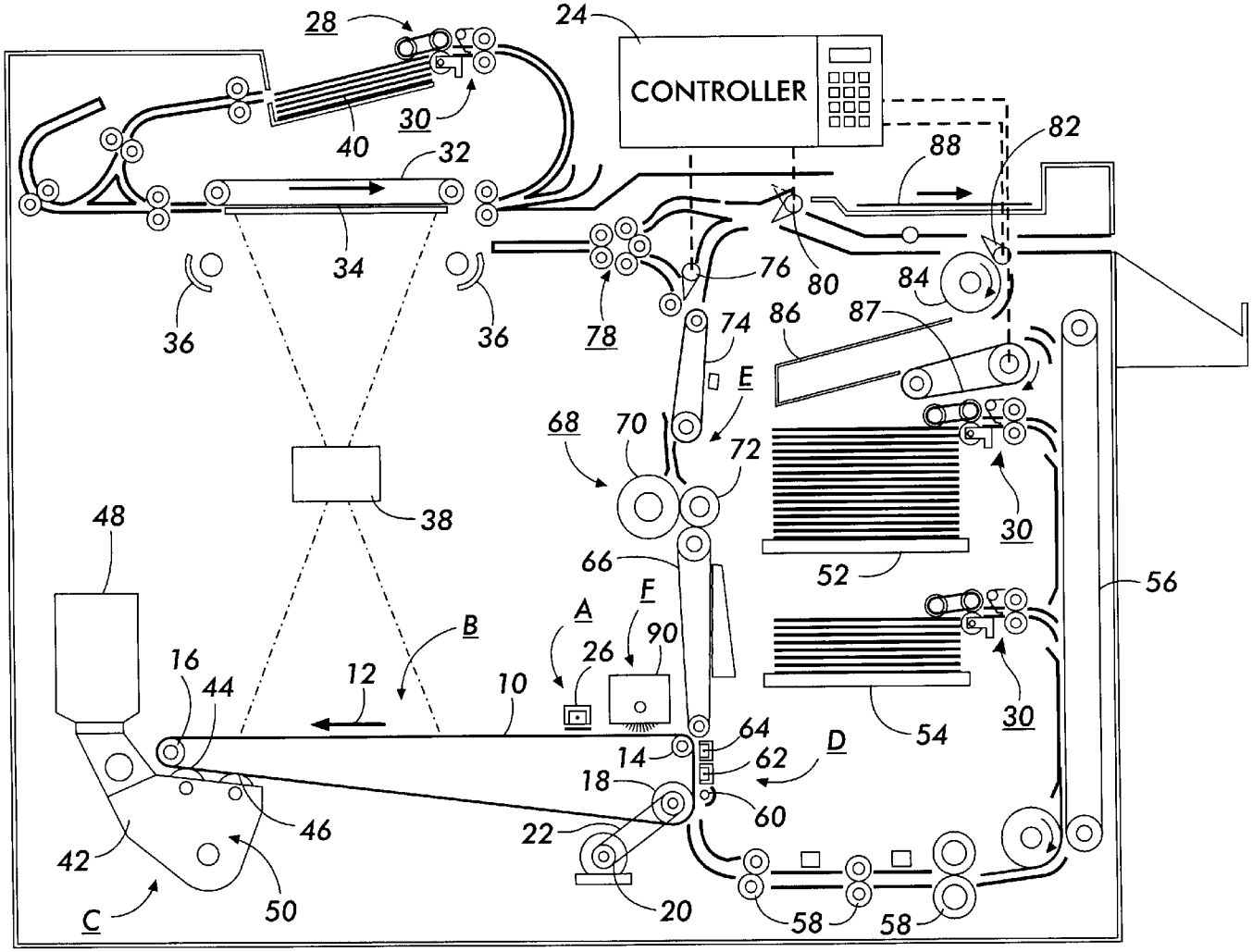

Other aspects of the present invention will become apparent as the following description proceeds and upon reference to the drawings, in which:

FIG. 1 is a schematic, elevational view partially in perspective, showing the system for predicting the location of sheets after a jam; and FIG. 2 is a schematic, elevational view showing an illustrative electrophotographic printing machine incorporating the features of the present invention therein.

While the present invention will hereinafter be described in connection with a preferred embodiment and method of use thereof, it will be understood that it is not intended to limit the invention to that embodiment or method of use. On the contrary, it is intended to cover all alternatives, modifications, and equivalents that may be included within the spirit and scope of the invention as defined by the appended claims.

For a general understanding of the features of the present invention, reference is made to the drawings. In the drawings, like reference numerals have been used throughout to identify like elements. Turning initially to FIG. 2, FIG. 2 schematically depicts the various components of the illustrative electrophotographic printing machine incorporating the sheet jam detection system of the present invention therein. It will become apparent from the following discussion that this sheet jam detection system is equally well suited for use in a wide variety of printing machines and is not necessarily limited in its application to the particular embodiment and method of use discussed herein. Furthermore, the sheet jam detection system may be used in a non-printing machine environment. It may be used in any transport system in which it is desirable to predict the location of sheets after the occurrence of a sheet jam.

Inasmuch as the art of electrophotographic printing is well-known, the various processing stations in the FIG. 2 printing machine will be hereinafter shown schematically and their operation described briefly with reference thereto.

As shown in FIG. 2, the illustrative electrophotographic printing machine employs a belt 10 having a photoconductive surface comprising an anti-curl layer, a supporting substrate layer, and an electrophotographic imaging single layer or multiple layers. The imaging layers may contain heterogeneous, inorganic, or organic composition. Preferably, finely divided particles of the photoconductive inorganic compound are dispersed in an electrically insulating organic resin binder. Generally, these inorganic photoconductive materials are deposited as a relatively homogeneous layer. The anti-curling layer may be made of any suitable film such as a flexible thermoplastic resin. The substrate layer may be made from any suitable conductive material, such as Mylar®. Another well-known conductive material that can be used in the substrate layer is aluminum. Belt 10 moves in the direction of arrow 12 to advance successive portions of the photoconductive surface sequentially through the processing stations disposed about the path of movement thereof.

Belt 10 is entrained about stripping roller 14, tensioning roller 16, and drive roller 18. Stripping roller 14 is mounted rotatably so as to rotate with belt 10. Tensioning roller 16 is resiliently urged against belt 10 to maintain belt 10 under the desired tension. Drive roll 18 is rotated by a motor coupled thereto by suitable means, such as a belt drive 22. A controller 24 controls motor 20 in a manner known to one skilled in the art to rotate roller 18. As roller 18 rotates, it advances belt 10 in the direction of arrow 12. An encoder wheel 19 (shown at FIG. 1), is mounted on the shaft of roller 18 and rotates in unison therewith to indicate the location of various portions of belt 10.

Initially, a portion of the photoconductive surface of belt 10 passes through charging station A. At charging station A, a corona generating device, indicated generally by the reference numeral 26, charges the photoconductive surface to a relatively high, substantially uniform potential.

Next, the charged portion of the photoconductive surface is advanced to imaging station B. Imaging station B includes a document handling unit, indicated generally by the reference numeral 28. Document handling unit 28 sequentially feeds successive original documents from a stack of original documents placed by the operator face up in the normal forward collated order on the document handling and supporting tray. The uppermost sheet of the stack of documents is placed closely adjacent to a sheet feeder, indicated generally by the reference numeral 30. Sheet feeder 30 advances the topmost sheet from the stack of document to transport belt 32. Transport belt 32 advances the original document to platen 34. At platen 34, the original document is positioned face down. Lamps 36 illuminate the original document on transparent platen 34. Light rays reflected from the original document are transmitted through lens 38. Lens 38 forms a light image from the original document which is projected onto the charged portion of the photoconductive surface of belt 10 to selectively dissipate the charge thereon. This records an electrostatic latent image on the photoconductive surface which corresponds to the informational areas contained in the original document. After illumination, the original document returns to the bottom of the stack of documents supported on tray 40.

After imaging, belt 10 advances the electrostatic latent image recorded on the photoconductive surface to development station C. At development station C, a magnetic brush developer unit, indicated generally by the reference numeral 42, advances developer material into contact with the electrostatic latent image recorded on the photoconductive surface of belt 10. Preferably, magnetic brush development unit 42 includes two magnetic brush development rollers 44 and 46. These rollers each advance developer material into contact with the latent image. Each developer roller forms a brush comprising carrier granules and toner particles. The latent image attracts the toner particles from the toner granules, forming a toner powder image on the photoconductive surface of belt 10. As successive latent images are developed, particles are depleted from developer unit 42. A toner powder dispenser 48 furnishes additional toner particles to developer housing 50 for subsequent development by the developer unit. Toner particle dispenser 48 stores a supply of toner particles which are subsequently dispensed into the developer housing 50 to maintain the concentration of toner particles therein substantially uniform. After the latent image is developed with toner particles to form a toner powder image on the photoconductive surface of belt 10, belt 10 advances the toner powder image to transfer station D.

At transfer station D, a copy sheet is moved into contact with the toner powder image recorded on the photoconductive surface of belt 10. Copy sheets are fed from either tray 52 or 54. Each of these trays has a stack of sheets thereon. Sheet feeder 30 is also used herein to advance the topmost sheet of the stack. Conveyer 56 receives the sheet advanced from the respective feed tray by sheet feeder 30 and advances it to feed rollers 58. Feed rolls 58 advance the sheet to transfer station D. Sheet jam detection devices 59 are located adjacent conveyer 56 and between feed rolls 58, as well as being positioned adjacent all other sheet paths. The details of sheet jam detection device 59 will be described hereinafter with reference to FIG. 1. Prior to transfer, lamp 60 illuminates the toner powder image adhering to the photoconductive surface of belt 10 to reduce the attraction therebetween. Thereafter, a corona generating device 62 sprays ions onto the backside of the copy sheet. The copy sheet is charged to the proper magnitude and polarity so that the copy sheet is tacked to the photoconductive surface of belt 10 and the toner powder image attracted thereto. After transfer, a corona generating device 64 charges the copy sheet to the opposite polarity to detack the sheet from belt 10. Conveyer 66 advances the copy sheet to fusing station E.

Fusing station E includes a fusing assembly indicated generally by the reference numeral 68, which permanently affixes the transferred toner powder image to the copy sheet. Preferably, fuser assembly 68 includes heater fuser roller 70 and back-up roller 72 with the powder image on the copy sheet contacting the fuser rolls 70. Back-up roller 72 is cammed against the fuser roller 70 to provide the necessary pressure to permanently affix the toner powder image to the copy sheet. After fusing, conveyer 74 advances the copy sheet to gate 76. Gate 76 functions as an inverter selector. Depending upon the position of gate 76, the copy sheet will either be deflected into a sheet inverter, indicated generally by the reference numeral 78 or bypass the inverter 78 and be fed directly into a second decision gate 80. The copies which bypass inverter 78 are inverted so that the image side which has been transferred and fused is face up at this point. However, if the inverter path is selected, the opposite is true and the last printed side is face down. Decision gate 80 then either deflects the sheet directly into an output tray 88 or deflects the sheet into the transport path which carries them on without inversion to a third decision gate, 82. Decision gate 82 either passes the sheet directly on without inversion into the output path of the printing machine or deflects the sheet into a duplex inverting roller transport 84. Inverting roller 84 inverts and stacks the sheets to be duplexed in duplex tray 86. Duplex tray 86 provides buffer storage for those copies which have been printed on one side and on which an image will be printed subsequently on the opposed side. For those sheets being duplexed, the process is repeated, with the fused image being affixed to the opposed side.

Invariably, after the copy sheet is separated from the photoconductive surface of belt 10 and transfer station D, some residual particles remain adhering thereto. These residual particles are removed from the photoconductive surface at cleaning station F which includes a rotatably mounted fibrous brush 90 in contact with the photoconductive surface. The particles are cleaned from the photoconductive surface by the rotation of the brush in contact therewith. Subsequent to cleaning, a discharge lamp (not shown) floods the photoconductive surface with light to dissipate any residual or electrostatic charge remaining thereon prior to the charging thereof for the next cycle.

Controller 24 is preferably a programmable microprocessor which controls all of the machine steps and functions heretofore described. Controller 24 includes a processor 25 and a display 27, both of which are shown in FIG. 1. Exemplary control systems for use in electrophotographic printing machines are described in U.S. Pat. No. 4,062,061, issued Dec. 6, 1977 to Batchelor, et al.; U.S. Pat. No. 4,132,155 issued Oct. 31, 1978 to Upert; U.S. Pat. No. 4,125,325, issued Nov. 14, 1978 to Batchelor, et al.; and U.S. Pat. No. 4,144,550 issued Mar. 13, 1979 to Donohue, et al., the relevant portions of the foregoing patents being incorporated into the present application.

It is believed that the foregoing description is sufficient for purposes of the present application to illustrate the general operation of an electrophotographic printing machine incorporating the sheet jam detection apparatus of the present invention therein.

Referring now to FIG. 1, encoder wheel 19 is mounted on shaft 21 which in turn also has roller 18 mounted therein. A light source 92, such as a light emitting diode, is disposed on one side of encoder wheel 19. Photosensor 94 is located on the other side of encoder wheel 19. Encoder wheel 19 has a multiplicity of equally spaced slots 96 in the marginal region thereof. As slots 96 pass between light source 92 and photosensor 94, photosensor 94 transmits a signal to processor 25. A sheet is advanced by forwarding rollers 58 in the direction of arrow 98 between plates 100. A light source 102, for example a light emitting diode, is disposed adjacent one of the plates opposed from an opening therein, and photosensor 104 is positioned adjacent the other plate opposed from an opening therein. The openings in plate 100 are colinear with one another and light rays emitted form light source 102 are received by photosensor 104. When the sheet moving in the direction of arrow 98, is interposed between light source 102 and photosensor 104, no light rays are received by photosensor 104. Processor 25 receives the signals from photosensor 104. Processor 25 detects when the lead edge of the sheet is sensed or interposed between light source 102 and photosensor 104, and when the trail edge of the sheet exits from between light source 102 and photosensor 104. Processor 25 periodically interrogates photosensor 104. If the time interval between receiving the signal indicating that the leading edge has been interposed between photosensor 104 and light source 102 and that the trailing edge of the sheet has exited therebetween exceeds a predetermined time interval, processor 25 indicates that a sheet jam has occurred along a path of movement of the sheet and generates a sheet jam signal. In response to the sheet jam signal, the printing machine is shut down. However, due to the high speed of the printing machine, other sheets in the sheet path of the printing machine will continue to advance and have to be removed therefrom as well as the jammed sheet. The effect of this inertia is measured by determining when the photoconductive belt 10 stops moving. Thus, processor 25 interrogates photosensor 94 and determines when encoder wheel 19 is no longer rotating. At this time, processor 25 develops a photoconductor signal. Processor 25 includes information as to the size of the sheet, and basis or weight of the sheets being advanced in the printing machine. This information may be inputted by the machine operator. In addition, processor 25 measures the time interval between receiving the sheet jam signal and the photoconductor signal. Processor 25 then predicts the location of the sheets in the sheet path of the printing machine as a function of the measured time interval between the sheet jam signal and the photoconductor signal, and the basis or weight of the copy sheets being advanced in the printing machine. In addition, the size or length of the sheet is also used as a parameter to assist in predicting sheet location.

In recapitulation, it is clear that the sheet jam detection device of the present invention determines the initial location of the jammed sheet and determines the continued movement of any sheets along the sheet path of the printing machine. This is accomplished by measuring the time interval between detecting the sheet jam and detecting when the photoconductive belt stops moving. Alternatively, encoder 19 may be mounted on the drive system advancing the sheet. In this instance, the signal will be indicative of the continued drive mechanism's movement after the jammed sheet is detected. In this way, it is clear that the sheet jam detection system of the present invention may be used in any sheet transport system. The sheet parameters, such as weight and size, are also used to assist in predicting the location of the sheets along the sheet path after the occurrence of a sheet jam.

It is, therefore, evident that there has been provided in accordance with the present invention, a sheet jam detection system which fully satisfies the aims and advantages hereinbefore set forth. While this invention has been described in conjunction with a specific embodiment and method of use thereof, it is evident that many alternatives, modifications, and variations will be apparent to those skilled in the art. Accordingly, it is intended to embrace all such alternatives, modifications and variations which may fall within the spirit and scope of the appended claims.

I claim:

1. A printing machine having a moving photoconductive member, and processing stations disposed about the photoconductive member to form indicia on a sheet moving along a path, including:

a jam detecting device, disposed along the path of movement of the sheet, for detecting a sheet jam along the path of movement thereof and generating a sheet jam signal;

a sensor, operatively associated with the photoconductive member, to detect continued movement of the photoconductive member after said jam detecting device detects the sheet jam and generates a photoconductor signal; and a processor, in communication with said jam detecting device and said sensor for receiving the sheet jam signal and the photoconductor signal to predict locations of sheets along the path after the sheet jam occurs.

2. A printing machine according to claim 1, further including a display, in communication with said processor, to display the locations of the sheets.

3. A printing machine according to claim 2, wherein said processor predicts the sheet location as a function of sheet weight.

4. A printing machine according to claim 3, wherein said processor predicts sheet location as a function of a measured time interval between the jam signal and the photoconductor signal.

5. A printing machine according to claim 4, wherein said processor predicts sheet location as a function of sheet size.

6. A printing machine according to claim 1, wherein said jam detecting device includes:

a sheet detector mounted along the path of movement of the sheet for detecting the trailing edge of the sheet; and a timing device, coupled to said sheet detector, to interrogate periodically said sheet detector and produce the sheet jam signal in response to said sheet detector failing to detect the trailing edge of the sheet within a predetermined time period.

7. A printing machine according to claim 6, wherein said sensor includes an encoder.

8. An apparatus for predicting a location of a sheet being advanced along a path of movement by a transport after an occurrence of a sheet jam, including:

a jam detecting device, disposed along the path of movement of the sheet, for detecting a sheet jam along the path of movement thereof and generating a sheet jam signal;

a sensor, operatively associated with the transport, to detect continued movement of the transport after said jam detecting device detects the sheet jam and generates a transport signal; and a processor in communication with said jam detecting device and said sensor, for receiving the sheet jam signal and the transport signal to predict the location of the sheet in the path of movement after the sheet jam occurs.

9. An apparatus according to claim 8, further including a display, in communication with said processor, to display the location of the sheet after the sheet jam occurs.

10. An apparatus according to claim 9, wherein said processor predicts the location of the sheet as a function of sheet weight.

11. An apparatus according to claim 10, wherein said processor predicts the location of the sheet as a function of a measured time interval between the jam signal and the transport signal.

12. An apparatus according to claim 11, wherein said processor predicts the location of the sheet as a function of sheet size.

13. An apparatus according to claim 8, wherein said jam detecting device includes:

a sheet detector mounted along the path of movement of the sheet for detecting the trailing edge of the sheet; and a timing device, coupled to said sheet detector, to interrogate periodically said sheet detector and produce the sheet jam signal in response to said sheet detector failing to detect the trailing edge of the sheet within a predetermined time period.

14. An apparatus according to claim 13, wherein said sensor includes an encoder.

15. A method of predicting sheet locations of a sheet after a sheet moving along a path in a printing machine jams wherein the printing machine includes processing stations disposed about a photoconductive member to form indicia on the sheets, including:

detecting a sheet jam along the path of movement thereof and generating a sheet jam signal;

sensing continued movement of the photoconductive member after said detecting step and generating a photoconductor signal; and processing the sheet jam signal and the photoconductor signal to predict the sheet locations after the sheet jam occurs.

16. A method according to claim 15, further including displaying the location of the sheet after the sheet jam occurs.

17. A method according to claim 16, wherein said processing step includes predicting the location of the sheet as a function of sheet weight.

18. A method according to claim 17, wherein said processing step includes predicting the location of the sheet as a function of a measured time interval between the sheet jam signal and the photoconductor signal.

19. A method according to claim 18, wherein said processing step includes predicting the location of the sheet as a function of sheet size.

20. A method according to claim 16, said detecting step includes:

using a sheet detector for sensing the trailing edge of the sheet; and interrogating periodically the sheet detector and producing the sheet jam signal in response to the sheet detector failing to detect the trailing edge of the sheet within a predetermined time period.

21. A method according to claim 20, wherein said sensing step includes using an encoder to detect continued movement of the photoconductive member.

* * * * *